United States Patent [19]

Leach et al.

[11] Patent Number: 4,658,358

[45] Date of Patent: Apr. 14, 1987

[54] UNDERWATER COMPUTER

[75] Inventors: Eugene R. Leach; James A. Robbins; Steven B. Helton; Jeffrey J. Webb, all of Columbus, Ohio

[73] Assignee: Battelle Memorial Institute, Columbus, Ohio

[21] Appl. No.: 620,299

[22] Filed: Jun. 13, 1984

[51] Int. Cl.[4] ..... G06F 15/42; H04B 11/00

[52] U.S. Cl. ..... 364/418; 73/861.5; 128/204.23; 128/205.23

[58] Field of Search ..... 364/418, 558; 73/432 D, 73/432 R; 128/204.23, 205.23

[56] References Cited

U.S. PATENT DOCUMENTS

| | | | |
|---|---|---|---|
| 3,992,948 | 11/1976 | D'Antonio | 364/418 X |
| 4,005,282 | 1/1977 | Jennings | 364/418 X |
| 4,109,140 | 8/1978 | Etra | 364/418 |
| 4,586,136 | 4/1986 | Lewis | 364/418 |
| 4,604,737 | 8/1986 | Hoffman et al. | 364/418 |

FOREIGN PATENT DOCUMENTS

| | | |
|---|---|---|
| 2072856 | 10/1980 | United Kingdom . |
| 2059071 | 4/1981 | United Kingdom . |

*Primary Examiner*—Jerry Smith
*Assistant Examiner*—Charles B. Meyer
*Attorney, Agent, or Firm*—Philip M. Dunson

[57] ABSTRACT

An apparatus for carrying by a diver while under water (and at the surface between dives) provides information useful for enabling the diver to ascend therefrom both expeditiously and safely in order to avoid decompression sickness. A corrosion-resistant ceramic transducer (60) provides an electrical capacitance responsive to the pressure of the water thereon, in an electronic circuit (52), comprising also a resistance (61), for providing a signal (at 53) responsive to the time constant therein and substantially unaffected by normally encountered variations in supply voltage. Electronic data processing means (40–51), responsive to the signal, computes the water pressure, the depth of the transducer (60) in the water, the minimum depth to which the diver can from there ascend safely, the minimum time within which the diver then can ascend safely to the surface of the water, and the elapsed time since the beginning of the dive. Displays (48, 49) provide indications to the diver of the computed values.

25 Claims, 5 Drawing Figures

FIG. I

UNDERWATER COMPUTER

This invention was made with Government support under contracts for research awarded by a Government laboratory. The Government has certain rights in this invention.

FIELD

This invention relates to apparatus for carrying by a diver while under water (and at the surface between dives) and for providing information useful for enabling the diver to ascend therefrom both expeditiously and safely in order to avoid decompression sickness. The apparatus is also capable of operating at the surface in a variety of ambient air pressure conditions, and maintains a continuing record of the diver's decompression status so as to be effective for multiple dives with varying depth profiles.

Such apparatus, according to the present invention, typically comprises transducer means for providing an electrical capacitance responsive to the pressure of the water thereon, electronic circuit means comprising a resistance means in circuit with the transducer capacitance means for providing a signal responsive to the time constant therein and substantially unaffected by normally encountered variations in supply voltage, electronic data processing means, responsive to the signal from the resistance-capacitance circuit means, for computing the water pressure, the depth of the transducer capacitance means in the water, the minimum depth to which the diver can from there ascend safely, the minimum time within which the diver then can ascend safely to the surface of the water, and the elapsed time since the beginning of the dive (so that the diver can know when he must start to ascend), and means for providing indications perceptible to the diver of the computed values.

BACKGROUND

Explosive ordnance disposal (EOD) divers can be required to conduct multiple, long duration, random-depth-profile dives, which make the effective use of conventional diving decompression tables difficult. The complication of the decompression routine caused by erratic diving profiles exposes the diver to increased possibilities of decompression sickness (DCS). A Government laboratory, in an attempt to minimize DCS occurrence, has developed a diver-worn processor capable of monitoring both diving depth and time. This information along with a decompression algorithm can be used to compute decompression profiles on a real time basis. The underwater decompression computer has been reportedly compatible with the Intel 8080 microprocessor technology. It was not, however, designed to meet the EOD specifications of magnetic effects limits for non-magnetic equipment and its electronic components would be expected to draw electrical currents unacceptable for EOD applications.

This effort was directed toward the design and fabrication of an operational breadboard unit of an Underwater Decompression Computer (UDC) for use in the proximity of magnetic influence ordnance. The key efforts in this design were the utilization of state-of-the-art low-current drain integrated circuit technology (CMOS technology) and advances in depth transducer technology. These were used to develop a device based upon decompression data and algorithms, as presented in References 3-5. The design and development of the UDC and the fabrication of a breadboard unit, in addition to being oriented toward achieving an EOD-acceptable low magnetic influence, has included concern for the following: long battery lifetime; compatibility with Oxygen-Nitrogen and Oxygen-Helium gas diving mixtures; capability of determining depths to 300 feet of sea water (FSW); operability over a temperature range of 29 to 93 degrees Fahrenheit; depth determination accuracy of +2 feet, −1 foot of sea water; and capability of displaying the diver depth and the calculated safe ascent depth.

The decompression algorithm used in the advanced underwater decompression computer of the present invention has become largely empirical, and is essentially derived from that of computing decompression profiles by Braithwaite which evolved from Workman's approach. The diver's depth is sensed at two second intervals and inert gas uptake or elimination is calculated for nine tissue half-time compartments. During gas uptake the partial pressure of inert gas in the tissue is governed by an exponential whereas when gas elimination from tissue occurs, the gas washout is assumed to be linear.

The compartment half-times are associated with various perfusion-limited tissues and range from 5 to 240 minutes. At the end of the two second interval, the microprocessor output provides an updated inert partial gas pressure for each compartment. Decompression is regulated by comparing the updated partial pressure in the nine compartments to a table of "M-values" which are stored in a read only memory (ROM). An "M-value" is the maximum permissible inert gas tissue tension in any of the nine half-time compartments at a given depth. By comparing M-values and the calculated partial pressures which are updated at two second intervals, a safe ascent depth (SAD) can be determined.

To establish a SAD, the microprocessor compares the inert gas pressures in each of the nine compartments to corresponding M-values, and displays the shallowest depth at which all computed compartment gas tensions are less than or equal to their respective M-values. The diver's actual depth is also displayed simultaneously with the SAD. The action required by the diver during ascent decompression is to move up to the SAD and stay there until the SAD changes to the next more shallow depth. At that time, the diver again moves up to the SAD. This process repeates until the diver finally surfaces.

The UDC essentially maintains a history of the dive. Thus, as long as the diver does not turn off the UDC, he can move from lower to higher depths as frequently as necessary, as long as he does not rise above the displayed SAD. This provides the diver decompression capability for single and multiple dives and is one benefit of the UDC concept.

The original UDC included a program change of oxygen partial pressures whenever the diver was at a depth of 3 feet or less. This programmed capability which is also included in the advanced UDC permits the diver to breathe ambient air while surfaced instead of the 0.7 oxygen mixture of the MK-15 and MK-16 Underwater Breathing Apparatus.

The UDC algorithm has been implemented in FORTRAN simulations in both floating point and fixed integer formats. The floating point simulation stores all values in a 24 bit format, not including the exponent. This simulation produces a decompression schedule and values for minimum time to surface that agree completely with the published diving tables.

The fixed integer simulation which was necessary prior to microprocessor development has been operated with variable bit lengths. The minimum bit length to produce near agreement with the diving tables is 12 bits in the multiplicative arguments with 24 bits saved in the final tissue pressure result. The values produced by using this bit length were found to vary from the published tables for long periods of dive time. The reason is that the pressure increment added to each tissue pressure for a two second interval is very small, and at 24 bits the truncation error becomes significant over many iterations.

To eliminate this truncation problem, the UDC algorithm has been implemented in the UDC assembly code using 16 bits (two 8 bit bytes) for each multiplicative argument with 32 bits saved in the final tissue pressure result. This implementation has been tested and compared to the results of a 32 bit integer FORTRAN simulation, and the comparison is exact except in the least significant bit.

Certain types of fuzes in mines and other types of ordnance respond to magnetic field changes having certain temporal properties. Such fuzes typically null themselves to their ambient magnetic field so that field changes induced by select targets moving in proximity to the fuze will result in fuze actuation and ordnance detonation.

The detection and neutralization of this class of ordnance requires equipment (such as the UDC) and techniques which would not adversely perturb the ambient fields near such ordnance. The standard for materials and tools involves field perturbations dealing with quasi-static magnetic field perturbations attributed to ferrous materials and steady state or slowly varying currents and eddy current generated magnetic fields. In order to minimize the static field perturbations resulting from ferrous materials, the materials used in EOD tools and equipment must have permeabilities close to unity. This condition is satisfied by most common alloys of aluminum, copper, and magnesium, as well as other materials such as leads and some stainless steels such as SS310. It is essential for the final UDC hardware that no ferrous impurities are contained in its materials and that fabrication procedures have not resulted in inadvertent magnetic property changes. To minimize steady state current effects, operating currents should not exceed one milliampere.

The eddy current generated magnetic fields are attributed to the circulating current induced in a conducting material by a time-varying magnetic field. Any moving conductor either in the form of a wire loop or simply a solid shape can, if not properly accounted for in the UDC design, induce unacceptable magnetic field perturbations. These effects need to be minimized by avoiding inductive loops in UDC electronic circuitry, by using eddy current minimizing laminations, by using materials having high electrical resistivity, and/or by using thin materials.

Pressure transducers typically rely on the measure of the deflection of one-side of a thin-walled structure. The deflection caused by the pressure changes on one side of such a structure can be correlated with the electrical signals using capacitive, inductive, piezoelectric, or peizoresistive techniques. Generally characteristics of these pressure sensing techniques are reported in Table I.

In general, recent advances in materials, fabrication, and packaging, combined with the rapid growth in signal processing capability have led to significant advances in pressure transducer performance at reduced cost. Many of these sensors utilize silicon

TABLE I

General Pressure Sensing Techniques

| | |
|---|---|
| CAPACITIVE | |
| Principle of operation | Deflections of pressure diaphragm acting as one plate of a parallel plate capacitor cause capacitance changes. |
| Pressure Range | 0.01–200 psi |
| Approximate Error | 0.05% |
| Advantages | High accuracy and sensitivity; ruggedness; temperature insensitivity. |
| Disadvantages | High cost; unsuitability for high pressure. |
| INDUCTIVE | |
| Principle of operation | Deflections of pressure diaphragm or Bourdon tube cause inductance changes in inductance bridge or differential transformer. |
| Pressure Range | 0.04–10,000 psi |
| Approximate Error | 0.5% |
| Advantages | High outputs; wide pressure range. |
| Disadvantages | Instability with temperature; susceptibility to shock and vibration. |
| PIEZOELECTRIC | |
| Principle of operation | Pressure on a quartz or Rochelle-salt crystal produces an electrostatic voltage across it. |
| Pressure Range | 0.1–10,000 psi |
| Approximate Error | 1% |
| Advantages | No need for excitation; wide pressure, frequency response, and temperature ranges. |
| Disadvantages | Low output; temperature sensitivity. |
| PIEZORESISTIVE | |
| Principle of operation | Pressure induced strain in sensing element causes resistance change in guages. |
| Pressure Range | 0.5–10,000 psi |
| Approximate Error | 0.25–0.5% |
| Advantages | High sensitivity; low hysteresis and cost (semiconductor types); ruggedness; wide temperature range. |
| Disadvantages | Low output; temperature sensitivity. |

circuitry with its accompanying problems related to its operation in various environments. Silicon circuitry has a tendency to be sensitive to adverse effects caused by temperature, moisture, magnetic fields, electromagnetic interference, and visible light. Thus, sensor packaging must allow the sensing element to be exposed to the environment while the on-board circuitry must be adequately protected. Many of the commercial sensors also draw electrical currents of tens of milliamperes which from a low magnetic influence and battery-drain perspective are unacceptable for the EOD UDC.

A review of the general characteristics of the various pressure sensing techniques in Table I readily shows that capacitive pressure transducers offer many of the advantages desired in the UDC. These include high accuracy, inherent ruggedness, and temperature insensitivity. Their principle disadvantage (i.e., high cost and unsuitability for high pressure) are currently relatively unimportant. The cited maximum pressure in their operating range of 200 psi corresponds to approximately 13–14 atmospheres or to a water depth measurement capability in excess of 400 feet of sea water (FSW). This depth exceeds the current UDC requirement to operate to depths of 300 FSW.

Silicon capacitive transducers have been developed by several organizations including Case Western Reserve University and Standford University. Commercially, Kavlico is producing several lines of capacitive transducers which incorporate microprocessor compatible signal conditioning electronics. Specifically, the Kavlico series P609 OEM pressure transducer utilizes an alumina capacitive sensing element, and has the specifications presented in Table II.

Although the current drain, operating voltage, and packaging for Kavlico devices were not directly amenable for use in the UDC, the ceramic alumina capacitive diaphragm was used as the basis for a low current drain (<<1 ma) transducer circuit design. Alumina is a well known ceramic which has been used frequently on military systems as an infrared dome and has well known, extensive media compatibility.

CMOS microprocessors which were reviewed for possible application in the advanced EOD underwater decompression computer included several 8 bit microprocessors and several 4 bit microprocessors. Overall evaluations of these microporocessors were made by considering the off-board/on-board RAM and ROM requirements, compatibility with LCD displays and available CMOS drivers, basic microprocessor architecture, development system hardware and software support requirements, total electrical current drain requirements, and capability for future hybridization/-miniaturization. Based on these evaluations and the decompression algorithm requirements, it was decided to use the Motorola MC146805, a CMOS microprocessor that contains a powerful subset of the M6800 instruction set. This instruction set includes indexed addressing, true bit manipulation, versatile interrupt handling, and a useful set of branch instructions.

TABLE II

| Kavlico Series P609 Pressure Transducer Specifications | |
|---|---|
| Pressure Ranges | Standard: 0–5, 0–15, 0–30, 0–75, 0–150 psi absolute or gage; Custom ranges available. |
| Proof Pressure | 150% FS. |
| Burst Pressure | 300% FS or 300 psi, whichever is less. |
| Pressure Media | Any media compatible with silicon rubber (Buna N or Fluorosilicone available as an option), Valox 420, and 96% alumina. |
| Cavity Volume | Less than 0.15 cu. in. |
| Volumetric Displacement | Less than .001 cu. in. |
| Pressure Connection | 0–5 through 0–15 psi: ¼" tube fitting or ¼"NPT; 0–30 psi and higher: ¼" NPT. |
| Electrical Connection | 3 solder lugs. |
| Weight | 4 ounces nomimal. |
| Mounting | Integrally molded flanges on T configuration; ¼"NPT pressure connection on P configuration. |
| Output | 2.0 to 6.0 VDC standard @ 9 VDC input. |
| Input Voltage | 9.00 VDC operable from 8–12 VDC; Output ratiometric to input. |
| Input Current | Less than 10 ma. |
| Output Impedance | Less than 100 ohms. |
| Load current | 2 ma maximum. |
| Output Ripple | Less than 10 mV rms (at approximately 1 KHz). |
| Polarity Protection | Protected against reverse voltage connection. |
| Repeatability | ±0.05% FS maximum. |
| Hysteresis | ±0.05% FS maximum. |
| Linearity | Better than ±1.6% FS. |
| Operating Life | More than 10 million cycles. |

TABLE II-continued

| Kavlico Series P609 Pressure Transducer Specifications | |
|---|---|
| Temperature Range | −40 degrees C. to +85 degrees C. standard; (−55 degrees C. to +125 degrees C. optional). |
| Temperature Stability | Span: ±0.01% FS/deg C.; Zero: ±0.01% FS/deg C. |
| Response Time | 15 ms maximum (5 ms available). |
| Body | Injection molded Valox 420. |
| Diaphragm and Substrate | 96% alumina. |
| Sensor-to-Housing Seal | Silicone rubber (Buna N or Fluorosilicone available). |
| Electronics | Custom integrated circuit, hybridized, bonded to substrate and shielded. |

This microprocessor is available in a version containing two kilobytes of on chip mask ROM or erasable programmable read only memory (EPROM).

Basically, the circuit design uses the changes in the decay time for the charged capacitor as part of a calibrated capacitor/resistor circuit to be correlated with sea water depth. In addition to requiring only extremely small currents for operation, this circuitry also is directly compatible with microprocessor logic, and does not require direct A-D conversion.

The pressure transducer circuitry may include a resistor the resistance of which will vary slightly with changes in temperature. Temperature changes will also affect the capacitive transducer, and the ideal RC circuit should match these two temperature variations in magnitude, but with opposite signs so that their temperature effects cancel.

During the developement of the UDC hardware and software, the microprocessor hardware was linked to a microprocessor development system through an in-circuit emulator. In order to test this hardware, a digital hardware simulation of the pressure transducer was built.

This transducer simulator receives a control pulse from the microprocessor hardware and returns an output pulse at a short time later exactly as the pressure transducer ordinarily would. The difference is that the time window between pulses is controlled by an 8 bit dip switch that can give time width from zero to a half second in discrete steps of 1/256th of a second. Using this simulator, the UDC microprocesor calibration software was tested, and some limited dive profiles were run to check the algorithm implementation, without actually using the pressure transducer.

The UDC decompression algorithm was coded both in FORTRAN and in MC146805 assembly code. The FORTRAN versions of the algorithm were merely simulations in order to establish that the algorithm that was implemented did indeed yield the same results as the published diving tables. Once this was established, then the FORTRAN simulation was converted to a fixed integer FORTRAN program that still yielded the same results, but that could be easily implemented in assembly code.

The FORTRAN algorithm is very compact: it requires only about fifty lines of uncommented code. However, this expands by an order of magnitude in the microprocessor assembly code. The entire software package resides in about 1650 bytes of EPROM. About half of the microprocessor code is used to implement the FORTRAN decompression algorithm and about half is used for I/O functions, interrupt routines, utility routines, initialization, etc.

The assembly code listings are well commented and follow the flow of the FORTRAN simulations directly. The results of the assembly code implementation agree with the FORTRAN results to within the least significant bit out of 32 bits used for one cycle through the code. Simulations have shown that agreement is required only down to the three least significant bits in order to match the published diving tables. This process of gradual translation of the decompression algorithm from a documented FORTRAN floating point simulation to the final assembly code implementation provides a higher level of confidence that the end result is operating as specified by the published diving tables.

The UDC software was developed on a Motorola EXORcisor II microprocessor development system using an in circuit emulator. With this configuration, the software was tested directly in the UDC hardware, and extensive software tools were available for program development and debug. The final version of the software was then burned into an EPROM and installed in the computer. Future modification of the software merely requires coding, testing using the UDC hardware with the in circuit emulator, and then burning a new EPROM with the updated software.

As described above, an advanced UDC intended for EOD applications and based on state-of-the-art low-current-drain integrated circuit (CMOS) electronic components has been bread-boarded. The breadboard hardware has been implemented using a Motorola MC146805 microprocessor and an eight-digit liquid crystal display (LCD). Actual diver sea water depth is determined by monitoring changes in the discharge time for a ceramic capacitive pressure sensor which is part of a calibrated RC circuit. This advanced UDC uses an algorithm developed by the U.S. Navy Experimental Diving Unit. The algorithm is based on a continuous updating of inert gas pressures in nine body tissues. The UDC displays a calculated diver safe ascent depth (SAD) in addition to the diver's actual depth.

DISCLOSURE

Typical apparatus according to the present invention for carrying a diver while under water (and at the surface between dives) and for providing information useful for enabling the diver to ascend therefrom both expeditiously and safely in order to avoid decompression sickness, comprises transducer means for providing an electrical capacitance responsive to the pressure of the water thereon, electronic circuit means comprising a resistance means in circuit with the transducer capacitance means for providing a signal responsive to the time constant therein and substantially unaffected by normally encountered variations in supply voltage, electronic data processing means, responsive to the signal from the resistance-capacitance circuit means, for computing the water pressure, the depth of the transducer capacitance means in the water, the minimum depth to which the diver can from there ascend safely, the minimum time within which the diver then can ascend safely to the surface of the water, and the elapsed time since the beginning of the dive (so that the diver can know when he must start to ascend), and means for providing indications perceptible to the diver of the computed values.

Typically the transducer capacitance means comprises essentially a ceramic capacitance that is highly resistant to corrosion, the resistance-capacitance circuit means comprises means for providing a signal that varies in duration as a function of the pressure on the transducer capacitance means, and the data processing means comprises means for providing a digital signal that is responsive to the said duration and thus avoids any need for conventional analog-to-digital conversion circuitry. The size, shape, and composition of the transducer capacitance means and the characteristics of the circuit, data processing, and indication providing means preferably are such as to draw substantially less than ten milliamperes in total current, and thus to assure long usable life of the source of current for the apparatus and essentially negligible magnetic influence on the surroundings.

The resistance-capacitance circuit means may include temperature compensating means, typically comprising means for varying the resistance in the circuit means responsive to the temperature of the water around the transducer capacitance means, as by having the resistance means comprise a thermistor.

The data processing means typically comprises means for providing the computed values accurately in any of a plurality of ambient conditions that the apparatus typically is to be used in.

The resistance-capacitance circuit means typically comprises means for providing a signal that varies in duration proportionally to the capacitance of the transducer means. The signal providing means typically comprises means for providing an oscillating voltage whose period is proportional to the time constant of the resistance-capacitance circuit means, and typically the oscillating-voltage-providing means comprises amplifier means, means for providing a first potential as a first input to the amplifier means, and means for providing a second potential as a second input to the amplifier means. The said resistance means typically is connected in circuit with the first input to the amplifier means. Where the amplifier means comprises an operational amplifier means, typically the said resistance means is connected between the first potential and a first input terminal of the operational amplifier means, and the second potential is connected to a second input terminal of the operational amplifier means. Typically included also are a voltage comparator means, means for connecting the output of the operational amplifier means to a first input terminal of the voltage comparator means, means for connecting a third potential to a second input terminal of the voltage comparator means, and means responsive to the voltage comparator means for periodically interchanging the connections of the first and third potentials.

The potential providing means typically comprise voltage source means connected to voltage divider means; means for connecting a first input terminal of the operational amplifier means in circuit with a first point, at a first potential, on the voltage divider means; means for connecting a second input terminal of the operational amplifier means in circuit with a second point, at a different potential, on the voltage divider means; and means for connecting a second input terminal of the voltage comparator means in circuit with a third point, at a still different potential, on the voltage divider means. The potential at the second point on the voltage divider means typically is midway between the potential at the first point and the potential at the third point.

The periodically interchanging means typically comprises means for first connecting the resistance means to the first point on the voltage divider means while connecting the second input terminal of the voltage comparator means to the third point, then connecting the resistance means to the third point on the voltage divider means while connecting the second input terminal of the voltage comparator means to the first point, then back to the first-mentioned connections, and so on alternately between the first-mentioned connections and the second-mentioned connections.

As an alternative to including temperature-compensating means in the circuitry as described above, the apparatus may include additional electronic circuit means comprising a resistance means, responsive to the temperature of the water (or air) around the pressure transducer means, in circuit with a capacitance means, for providing a signal responsive to the time constant therein and substantially unaffected by normally encountered variations in the supply voltage; and the data processing means then may include means responsive to the signal from the additional circuit means for correcting the computed value of the water (or air) pressure to compensate for variation in the response of the pressure transducer means with variation in the temperature of the ambient water (or air).

Apparatus according to the present invention for providing an electrical signal that varies in duration proportionally to the product of a resistance therein multiplied by a capacitance therein typically comprises operational amplifier means; capacitance means connected between the output terminal and a first-input terminal of the operational amplifier means; resistance means connected, at one end, to the first input terminal of the operational amplifier means and, at the opposite end, to means for providing a first potential; means for providing a second potential to a second input terminal of the operational amplifier means; means for connecting the output of the operational amplifier means to a first input terminal of voltage comparator means; means for providing a third potential to a second input terminal of the voltage comparator means; and means for periodically interchanging the value of the first potential with the value of the third potential. The second potential typically is midway between the first and third potentials.

Typically the potential providing means comprise voltage source means connected to voltage divider means; means for connecting the first input terminal of the operational amplifier means in circuit with a first point, at a first potential, on the voltage divider means; means for connecting the second input terminal of the operational amplifier means in circuit with a second point, at a different potential, on the voltage divider means; and means for connecting the second input terminal of the voltage comparator means in circuit with a third point, at a still different potential, on the voltage divider means. The periodically interchanging means typically comprises means for first connecting the resistance means to the first point on the voltage divider means while connecting the second input terminal of the voltage comparator means to the third point, then connecting the resistance means to the third point on the voltage divider means while connecting the second input terminal of the voltage comparator means to the first point, then back to the first-mentioned connections, and so on alternately between the first-mentioned connections and the second-mentioned connections.

DRAWINGS

CARRYING OUT THE INVENTION

Figure 1:
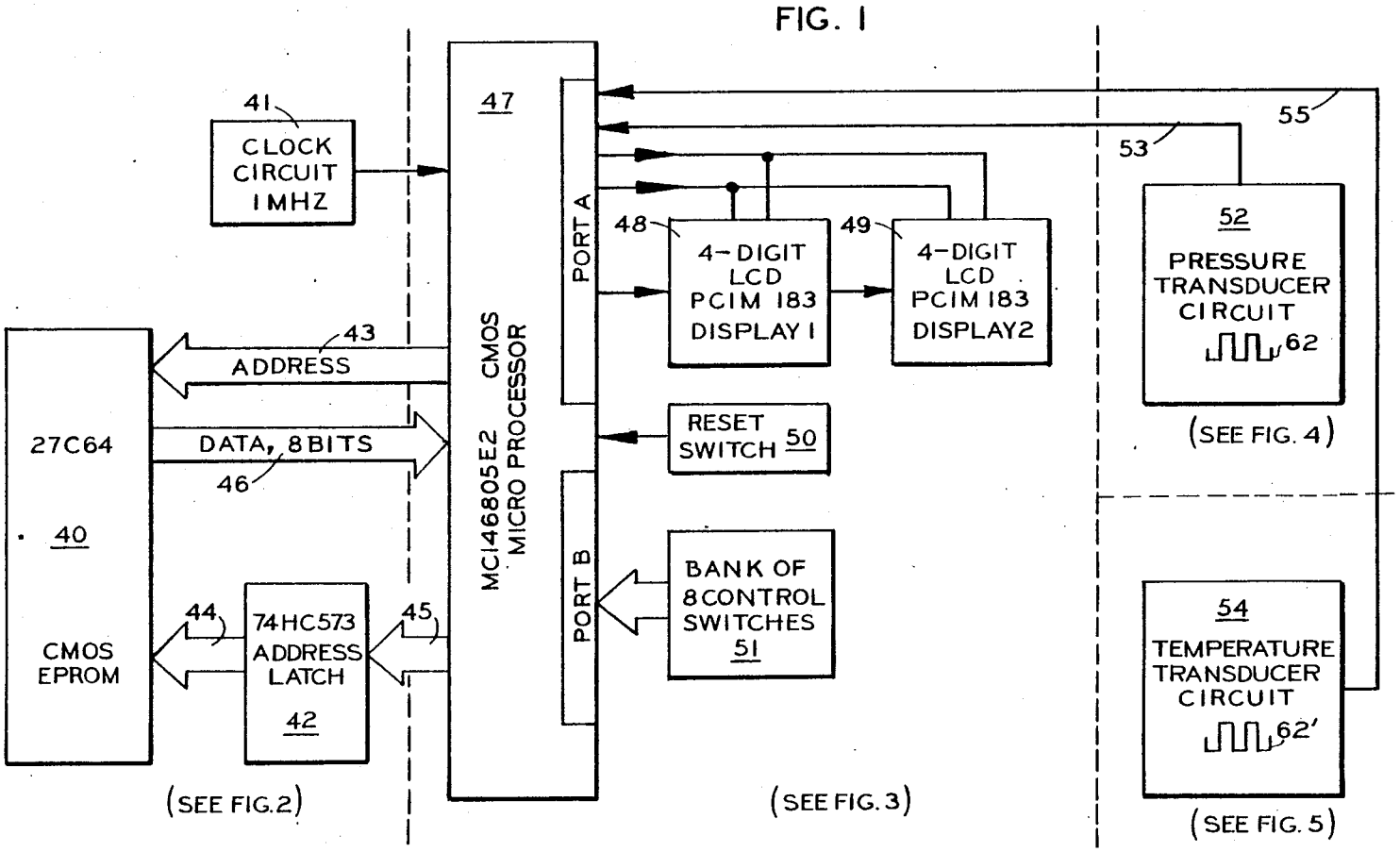
FIG. 1 is a block diagram of typical apparatus according to the present invention.
Figure 2:
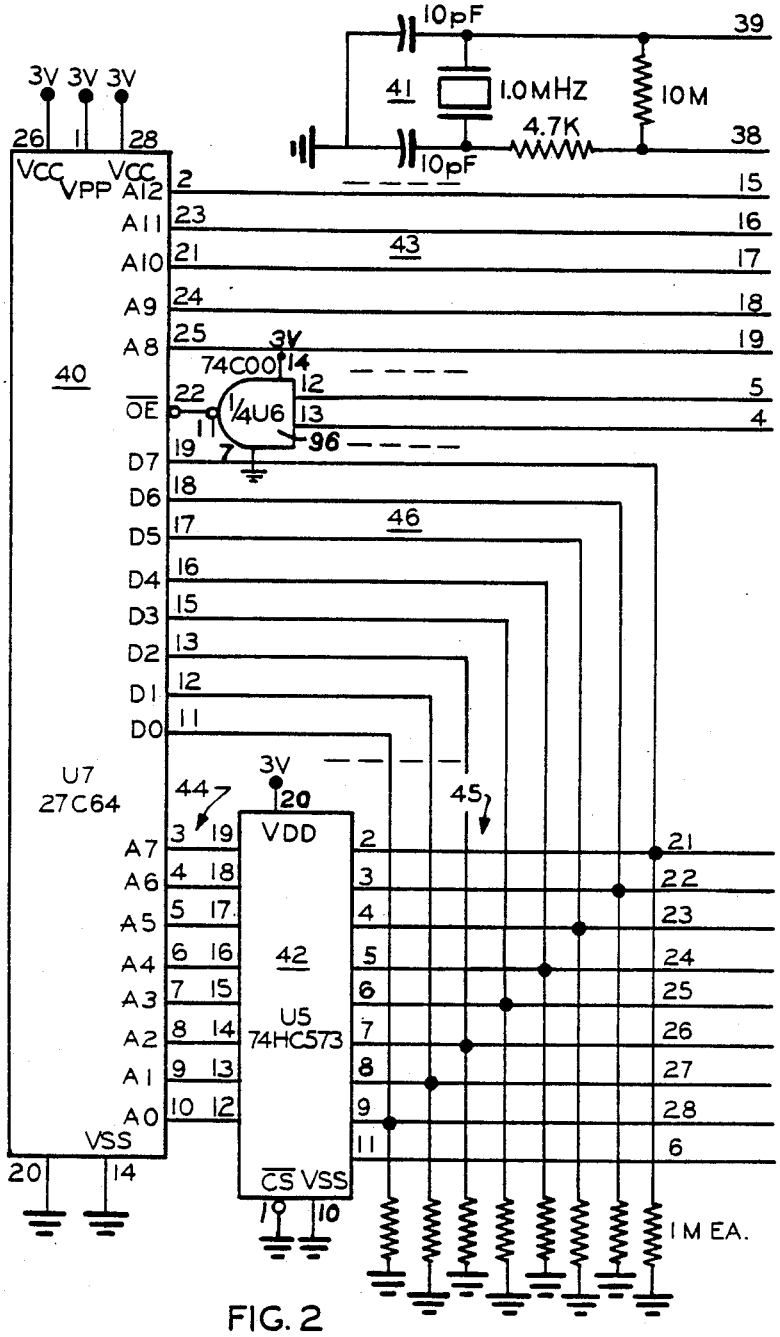
FIG. 2 is a schematic diagram of the portion of the apparatus in the left hand portion of FIG. 1 (to the left of the vertical dashed lines).
Figure 3:
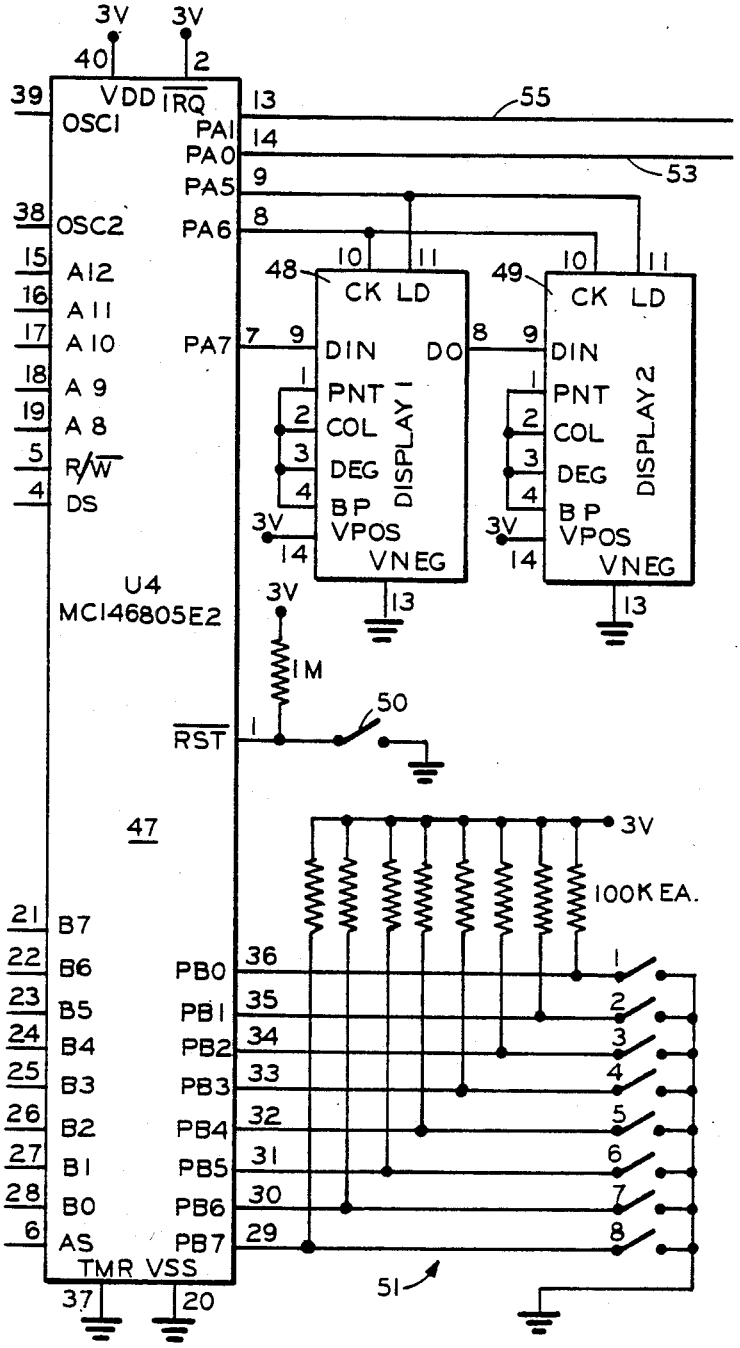
FIG. 3 is a schematic diagram of the portion of the apparatus in the middle portion of FIG. 1 (between the two vertical dashed lines).

FIG. 1 is a block diagram showing a typical embodiment that has been made of apparatus according to the present invention. Shown in the left hand portion of FIG. 1 (and in more detail in FIG. 2) are a type 27C64 complementary metal oxide semiconductor (CMOS) erasable programmable read-only memory (EPROM) 40, a 1 megaHertz clock circuit (typically a Pierce oscillator) 41, and a 74HC573 address latch 42. The EPROM 40 is operatively connected by address lines 43 and 44, the address latch 42, and address lines 45, and further by data lines 46, for control in the directions indicated by the arrowheads on the respective lines, with a type MC146805E2 CMOS microprocessor 47 shown in the middle portion of FIG. 1 (and in more detail in FIG. 3).

Also operatively connected with the microprocessor 47, for control in the directions indicated by the respective arrowheads, are a first PCIM183 four-digit liquid crystal display (LCD) 48 (Display 1), and a second similar display 49 (Display 2), a reset switch 50, and a bank of eight control switches 51.

The apparatus 40–51 provides electronic data processing means responsive to a pressure transducer circuit 52, shown in the upper right hand portion of FIG. 1 (and in further detail in FIG. 4), by way of a connecting line 53.

The pressure transducer circuit 52 may include temperature compensating means, or a temperature transducer circuit 54, as shown in the lower right hand portion of FIG. 1 (and in further detail in FIG. 5), may be operatively connected with the microprocessor 47, as indicated at 55, for correcting the computed value of the water pressure to compensate for variation in the response of the pressure transducer in the circuit 52 with variation in the temperature of the ambient water.

Typical apparatus according to the present invention for carrying by a diver while under water (and at the surface between dives), and for providing information useful for enabling the diver to ascend therefrom both expeditiously and safely in order to avoid decompression sickness, comprises transducer means 60 for providing an electrical capacitance responsive to the pressure of the water thereon, electronic circuit means 52 comprising a resistance means 61 in circuit with the transducer capacitance means 60 for providing a signal at 53 responsive to the time constant therein and substantially unaffected by normally encountered variations in supply voltage, electronic data processing means 40–51, responsive to the signal at 53 from the resistance-capacitance circuit means 52, for computing the water pressure, the depth of the transducer capacitance means 60 in the water, the minimum depth to which the diver can from there ascend safely, and the minimum time within which the diver then can ascend safely to the surface of the water, and means 48,49 (Display 1, Display 2) for providing indications perceptible to the diver of the computed values.

Typically the transducer capacitance means 60 comprises essentially a ceramic capacitance that is highly resistant to corrosion, the resistance-capacitance circuit means 52 comprises means for providing a signal at 53 that varies in duration as a function of the pressure on the transducer capacitance means 60, and the data processing means 40–51 comprises means for providing a digital signal that is responsive to the said duration and thus avoids any need for conventional analog-to-digital conversion circuitry. The size, shape, and composition of the transducer capacitance means 60 and the characteristics of the circuit 52, data processing 40–51, and indication providing means 48,49 preferably are such as to draw substantially less than ten milliamperes in total current, and thus to assure long usable life of the source of current for the apparatus and essentially negligible magnetic influence on the surroundings.

The resistance-capacitance circuit means 52 may include temperature compensating means, typically comprising means for varying the resistance in the circuit means responsive to the temperature of the water around the transducer capacitance means, as by having the resistance means 61 comprise a thermistor.

The data processing means 40–51 typically comprises means for providing the computed values accurately in any of a plurality of ambient conditions of pressure and temperature that the apparatus typically is to be used in. The apparatus can be used in the vicinity of magnetically detonatable explosives without triggering them; and it can bre used in extremely turbid water as means are provided for illuminating the displays.

The resistance-capacitance circuit means 52 typically comprises means for providing a signal at 53 that varies in duration proportionally to the capacitance of the transducer means. The signal providing means typically comprises means for providing an oscillating voltage (typically a square wave, as indicated at 62 in FIG. 1) whose period is proportional to the time constant of the resistance-capacitance circuit means 52, and typically the oscillating-voltage-providing means 52 comprises amplifier means 63, means for providing a first potential as a first input, at 64, to the amplifier means 63, and means for providing a second potential, at 65, as a second input to the amplifier means 63. The resistance means 61 typically is connected in circuit with the first input, at 64, to the amplifier means 63. Where the amplifier means comprises an operational amplifier means 63, typically the resistance means 61 is connected between the first potential, at 66, and a first input terminal 64 of the operational amplifier means 63, and the second potential, at 67, is connected to a second input terminal 65 of the operational amplifier means 63. Typically included also are a voltage comparator means 68, means for connecting the output, at 91, of the operational amplifier means 63 to a first input terminal 69 of the voltage comparator means 68, means for connecting a third potential, at 70, to a second input terminal 71 of the voltage comparator means 68, and means 72 responsive to the voltage comparator means 68 for periodically interchanging the connections of the first and third potentials, at 66 and 70.

The potential providing means typically comprise voltage source means, at 74, connected to voltage divider means 75,76,77,78; means 61,85,80 for connecting a first input terminal 64 of the operational amplifier means 63 in circuit with a first point 66, at a first potential, on the voltage divider means 75–78; means 81 for connecting a second input terminal 65 of the operational amplifier means 63 in circuit with a second point 67, at a different potential, on the voltage divider means 75–78; and means 82,84,83 for connecting a second input terminal 71 of the voltage comparator means 68 in circuit with a third point 70, at a still different potential, on the voltage divider means 75–78. The potential at the second point 67 on the voltage divider means 75–78 typically is midway between the potential at the first point 66 and the potential at the third point 70.

Figure 4:
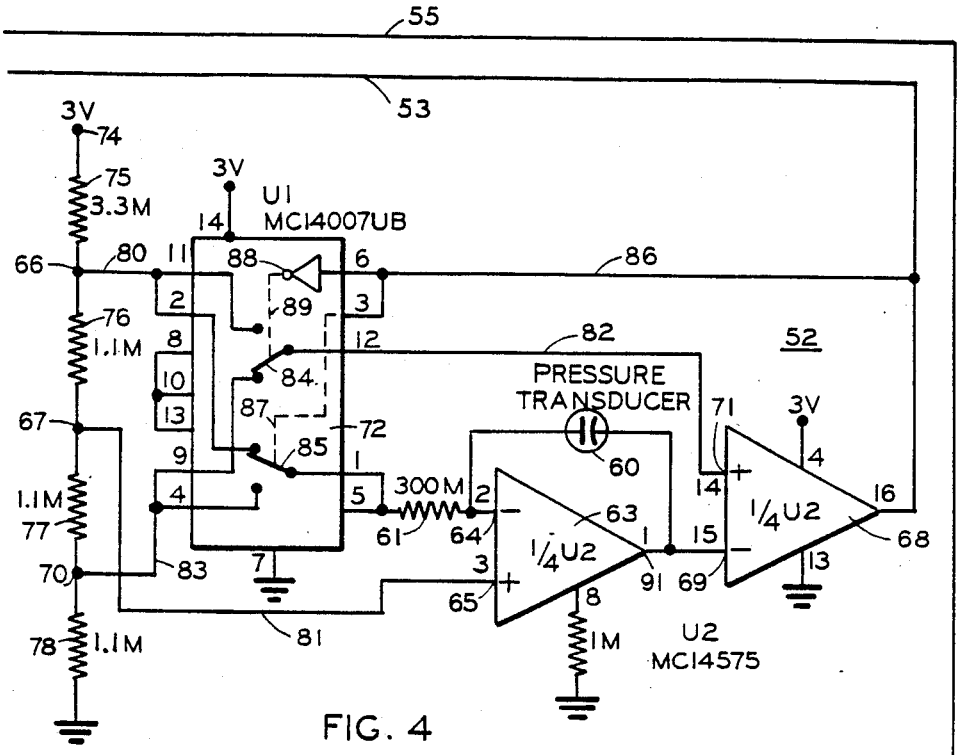
FIG. 4 is a schematic diagram of the portion of the apparatus in the upper right hand portion of FIG. 1 (above the horizontal dashed line).

The periodically interchanging means 72 typically comprises means 84,85 for first connecting the resistance means 61 (via 85,80) to the first point 66 on the voltage divider means 75–78 (the switch arm 85 being in its upper position as in FIG. 4) while connecting the second input terminal 71 of the voltage comparator 68 (via 82,84,83) to the third point 70 (the switch arm 84 being in its lower position as in FIG. 4), then connecting the resistance means 61 (via 85,83) to the third point 70 on the voltage divider means 75–78 (by throwing the switch arm 85 to its lower position, opposite to that shown in FIG. 4) while connecting the second input terminal 71 of the voltage comparator means 68 (via 82,84,80) to the first point 66 (by throwing the switch arm 84 to its upper position, opposite to that shown in FIG. 4), then back to the first-mentioned connections, and so on alternately between the first-mentioned connections and the second-mentioned connections.

As an alternative to including temperature-compensating means (at 61) in the circuitry 52 as described above, the apparatus may include additional electronic circuit means 54 (FIG. 5) comprising a resistance means 61′, responsive to the temperature of the water around the pressure transducer means 60, in circuit with a capacitance means 60′, for providing a signal responsive to the time constant therein and substantially unaffected by normally encountered variations in the supply voltage; and the data processing means then may include means responsive to the signal, at 55, from the additional circuit means 54 for correcting the computed value of the water pressure to compensate for variation in the response of the pressure transducer means 60 with variation in the temperature of the ambient water.

Referring now to FIG. 4, typical apparatus 52 according to the present invention for providing an electrical signal, at 53, that varies in duration proportionally to the product of a resistance 61 therein multiplied by a capacitance 60 therein comprises operational amplifier means 63; capacitance means 60 connected between the output terminal 91 and a first-input terminal 64 of the operational amplifier means 63; resistance means 61 connected, at one end, to the first input terminal 64 of the operational amplifier means 63 and, at the opposite end, to means 74,75 for providing a first potential, at 66; means 74,75,76 for providing a second potential, at 67, to a second input terminal 65 of the operational amplifier means 63; means for connecting the output at 91 of the operational amplifier means 63 to a first input terminal 69 of voltage comparator means 68; means 74,75,76,77 for providing a third potential, at 70, to a second input terminal 71 of the voltage comparator means 68; and means 72 for periodically interchanging the value of the first potential with the value of the third potential. The second potential, at 67, typically is midway between the first and third potentials, at 67 and 70.

Typically the potential providing means comprise voltage source means, at 74, connected to voltage divider means 75,76,77,78; means 61,85,80 for connecting the first input terminal 64 of the operational amplifier means 63 in circuit with a first point 66, at a first potential, on the voltage divider means 75–78; means 81 for connecting the second input terminal 65 of the operational amplifier means 63 in circuit with a second point 67, at a different potential, on the voltage divider means 75–78; and means 82,84,83 for connecting the second input terminal 71 of the voltage comparator means 68 in circuit with a third point 70, at a still different potential, on the voltage divider means 75–78. The periodically interchanging means 72 typically comprises means 84,85 for first connecting the resistance means 61 (via 85,80) to the first point 66 on the voltage divider means 75–78 (the switch arm 85 being in its upper position as in FIG. 4) while connecting the second input terminal 71 of the voltage comparator means 68 (via 82,84,83) to the third point 70 (the switch arm 84 being in its lower position as in FIG. 4), then connecting the resistance means 61 (via 85,83) to the third point 70 on the voltage divider means 75–78 (by throwing the switch arm 85 to its lower position, opposite to that shown in FIG. 4) while connecting the second input terminal 71 of the voltage comparator means 68 (via 82,84,80) to the first point 66 (by throwing the switch arm 84 to its upper position, opposite to that shown in FIG. 4), then back to the first-mentioned connections, and so on alternately between the first-mentioned connections and the second-mentioned connections.

The operational amplifier 63, resistor 61, and pressure transducer (capacitor) 60 form an integrator circuit. When a voltage that is different from the voltage present at the positive input 65 is placed at the input to the resistor 61 (and thus at the negative input 64), the output 91 of the operational amplifier 63 is a ramp voltage increasing in magnitude linearly with time in the direction of opposite polarity to the applied voltage difference. When the operational amplifier output voltage 91 applied to the voltage comparator negative input 69 reaches the potential present at the voltage comparator positive input 71 the voltage comparator 68 switches its output state 86, which changes the switch states at 84 and 85 and thus interchanges the voltages applied to the resistor 61 and to the comparator positive input 71. This causes the integrator circuit 60,61,63 to ramp in the opposite direction until the new voltage at 71 is reached and the voltage comparator 68 switches, thus interchanging the applied voltages again. This process forms a self starting oscillator whose period, t, is given by $$t = R_{61}C_{60}\left(\frac{R_{76}}{R_{77}} + \frac{R_{77}}{R_{76}} + 2\right).$$

This equation shows that the period of oscillation is independent of long term power supply voltage variations. Also it should be noted that the operational amplifier 63 never goes into saturation, thus eliminating the inaccuracies that are involved when such saturation occurs.

During one half cycle of each oscillation, the switch arm 85 is in its upper position (as in FIG. 4) by virtue of the direct action upon it, indicated at 87, from the output potential at 86; meanwhile the switch arm 84 is in its lower position (as in FIG. 4) by virtue of the opposite action upon it, indicated at 89, from the output voltage at 86 as inverted by the not gate 88. During the other half cycle of each oscillation, the polarity of the output potential at 86 is opposite from its former polarity, so the switch arm 85 is moved to its lower position and the switch arm 84 is moved to its upper position. Of course the double throw switches 84,85 are electronic components in the integrated circuit chip 72, and their functional representation as the equivalent mechanical relays is only for convenience in explaining the operation of the pressure transducer circuit 52.

Figure 5:
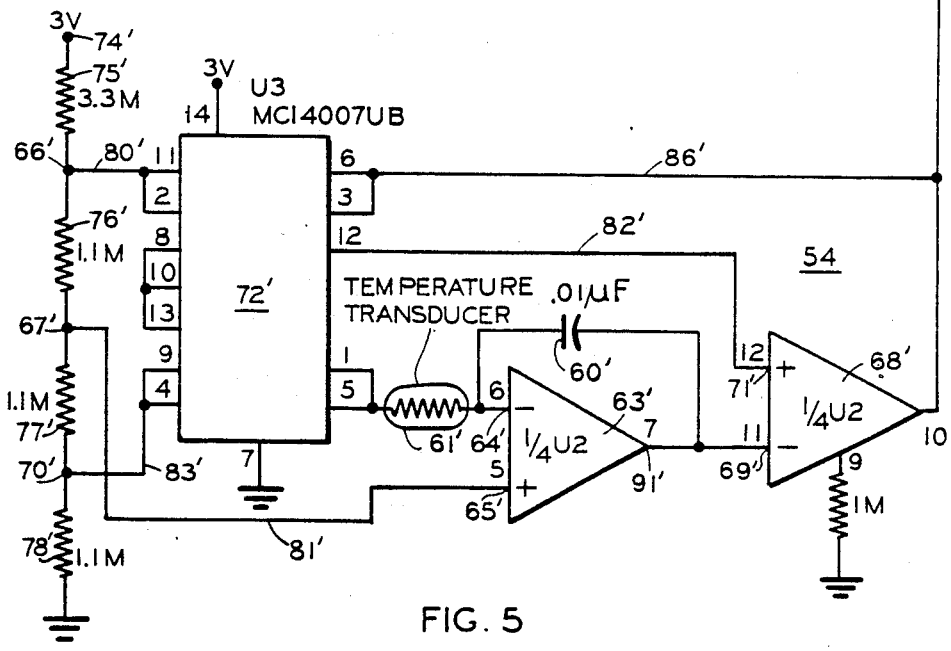
FIG. 5 is a schematic diagram of the portion of the apparatus in the lower right hand portion of FIG. 1 (below the horizontal dashed line).

The temperature transducer circuit 54 functions in the same manner as described above for the pressure transducer circuit 52. The integrated circuit chip 72' in FIG. 5 is identical to the chip 72 in FIG. 4, and the relevant internal circuitry is not shown again.

As now prefered and implemented, the data processing means 40–51 comprises means for carrying out the operations listed in the following summary:

DATA PROCESSING SOFTWARE SUMMARY
M6805 ASSEMBLY CODE IMPLEMENTATION

RESINT—Reset Interrupt Entry Point
  Initialize I/O Ports
  Initialize Timer
  Initialize Buffers
  Initialize Tissue Pressures
WAITLP—Wait Loop
  Wait for Timer Interrupt
  Is two-second interval flag set?
    No: Go to WAITLP
    Yes: Reset the flag
    Convert analog input to time
    Get depth from calibration curve
UPDATE—Update Tissue Pressures
  Pamb=Depth+33
  Is Depth<3 (i.e. at the surface)?
    Yes: PO2=0.21·Pamb
    No: PO2=0.7·Pamb
  PN2=Pamb−PO2−1.5
  Pexp=Pamb−4.3
  Plin=2.8−PO2
  FOR I=1 to 9
    Is P(I)>Pexp?

Yes: $\frac{dP(I)}{dt} = [.693/THT(I)] \cdot Plin$ $P(I) = P(I) + \frac{dP(I)}{dt} \cdot Wt$ No: $A(I) = P(I) - PN2$ $P(I) = P(I) + A(I) \cdot \mathrm{Exp}tb(I)$ NEXT I
  Compare Tissue Pressures to M values to get SAD
  Update Displays
  Go to WAITLP
EXTINT—External Interrupt Entry Point
  Return
SWIINT—Software Interrupt Entry Point
  Return
TIMINT—Timer Interrupt Entry Point
  Bump counter
  Have two seconds elapsed?
    No: Return
    Yes: Reset counter
    Set Flag
    Return
Where
  Depth is in feet of sea water Pamb is the ambient pressure
PO2 is the partial pressure of oxygen
PN2 is the partial pressure of nitrogen
Pexp is the exponential uptake cutoff pressure
Plin is the linear washout maximum rate
P(I) is a nine-element array of current tissue pressures
THT is a nine-element array of tissue half-times
Exptb(I) is a nine-element array of exponential gas uptake rates
M values are a nine-by-thirty-element array of maximum tissue pressures at depths of zero to 300 feet in ten-foot intervals
SAD is the safe ascent depth The underwater diving computer (UDC) comprises three basic modules: the pressure and temperature sensor circuits 52,54, the LCD displays 48,49, and the microprocessor 47(40–46,50,51). The pressure and temperature sensor curcuits 52,54 provide signals usable by the microprocessor from the respective sensors 60,61'. The LCD displays 48,49 provide readout to the user of data on safe ascent depth, etc. as provided by the microprocessor 47. The microprocessor 47 controls the entire unit, accepting information from the sensor circuits 52,54 and external, user-controlled switches 50,51 to perform calculations of safe ascent depth; and performing time-keeping functions.

Both the pressure and temperature circuits 52,54 operate on the basis of measuring the timing provided by an RC integrator 60,61,63; 60',61',63'. In the case of the pressure circuit 52, the pressure transducer 60 acts as a variable capacitor with a nominal value of 85 picofarads. This transducer 60 acts as the feedback element in a conventional RC integrator circuit 60,61,63 using an operational amplifier 63. The rate of change of the output voltage at 91 of this integrator circuit 63 is determined by the value of the capacitive element 60. In the temperature circuit 54, the temperature sensor (thermistor) 61' acts as the series resistor in a similar integrator circuit 60,61',63', with the feedback capcitor 60' being fixed. The rate of change of the output voltage at 91' of this circuit is dependent on the value of the thermistor 61'. These integrator circuits are contained within circuits which generate periodic rectangular voltage signals whose periods are proportional to the value of the pressure or temperature transducer.

The output voltage of the integrator, as it increases, is compared with a fixed reference voltage level. When it reaches the reference level, the direction of change of the output of the integrator is reversed, and the reference voltage level is reduced. The integrator output falls to the new reference, is reversed, the reference level is returned to its original value, and the cycle repeats. The output of the voltage comparator, which compares the integrator output with the reference voltage, provides the previously mentioned rectangular voltage signal. This signal is applied to an input of the microprocessor, where its period is measured. By means of calculation, the measured period is converted to a pressure or temperature value, as the case may be.

The microprocessor 47 used in the present implementation of the underwater diving computer is the Motorola MC146805. This 8-bit unit utilizes CMOS technology to minimize current drain. CMOS parts are also used wherever possible in the remainder of the circuit.

The liquid crystal displays (LCDs) 48,49 present data to the diver on depth, time, and safe ascent depth. The displays 48,49 are controlled by the microprocessor 47, which loads data into the displays 48,49 in a bit-serial format using three control lines (PA5,PA6,PA7).

In a typical preferred and satisfactorily demonstrated embodiment of the invention:

The resistances of the fixed resistors are as shown in the drawings. Each resistor is rated at $\frac{1}{4}$ watt and 5% tolerance, except the resistor 61 in FIG. 4, which is rated at 1 watt and 2% tolerance.

The capacitances of the fixed capacitors also are as shown in the drawings. The two capacitors in the clock circuit 41 are ceramic capacitors. The capacitor 60' in the temperature transducer circuit 54 is a monolithic capacitor.

The capacitive pressure transducer 60 is a Kavlico, type P609, transducer as in Table II.

The resitive temperature transducer 61' is a Dale, type 7C1003, thermistor.

The crystal in the clock circuit 41 is a Statek, type CX-IV, 1.0 MHz miniature crystal.

The 3-volt supply, to which all of the points labelled "3 V" are connected, is a size "N" carbon-zinc battery. A 0.01 $\mu$F ceramic capacitor is connected between the circuit ground and each 3 V point.

The reset switch 50 is a single-pole single-throw, normally open, momentary pushbutton.

The 8 control switches 51 are single-pole single-throw subminiature toggle switches.

Each periodically interchanging means 72,72' comprises a Motorola, type MC14007UB, dual complementary pair plus inverter integrated circuit chip; U1,U3.

Each operational ampliifer means 63,63' and each comparator means 68,68' comprises one-fourth of a Motorola, type MC14575, dual/dual programmable operational amplifier-comparator chip; U2.

The microprocessor 47 comprises a Motorola, type MC146805E2, CMOS 8-bit microprocessor chip; U4.

The address latch 42 comprises a National Semiconductor, type MM74HC573, octal D-type latch chip; U5.

The output enable (OE) gate 96 ($\frac{1}{4}$ U6), actuated by the read/write (R/W) and data select (DS) signals from the microprocessor 47 comprises one-fourth of a National Semiconductor, type MM74C00, CMOS quad two-input nand gate chip; U6.

The read only memory means 40, in which the M685 assembly code implementation program resides, comprises a Fujitsu, type MBM27C6430, CMOS 64-kilobit EPROM; U7.

Each indication-providing means 48,49 comprises a type PCIM183, four-digit liquid crystal display chip; Display 1, Display 2.

Pin numbers adjacent to the chips and portions of chips in FIGS. 2–5 identify the proper connections thereto.

FORTRAN Simulation of the UDC Algorithm, 32 Bit Integer

The following pages contain a source listing of the UDC algorithm as coded in FORTRAN using double precision (32 bit) integer variables and arrays.

```
      PROGRAM CHIP
C
      INTEGER*4 IP(9),IDPDT
      DIMENSION M(9,30),ITHT(9),IEXPTB(9),RM(9)
C
      DATA IEXPTB/2411,1208,604,302,151,100,75,60,50/
      DATA ITHT/300,600,1200,2400,4800,7200,9600,12000,14400/
      DATA RM/120,98,78,56,48.5,45.5,44.5,44,43.5/
      DATA IP/9*51527028/
C
      WRITE(5,7781)IP(1)
 7781 FORMAT(' ','IP(1):',O12)
      WRITE(5,1102)
 1102 FORMAT(' ','Output to disk (0=no, 1=yes)? ',$)
      READ(5,*)ILUNSW
      LUNOUT=5
      IF(ILUNSW.EQ.1)LUNOUT=1
C
      IEXP=19                !GOOD FOR IDTIME=2
      IDTIME=2
      NEXP=21
      SHIFT=2.**NEXP
C
      IBDEPT=150
      WRITE(5,1103)
 1103 FORMAT(' ','Bottom Depth? ',$)
      READ(5,*)IBDEPT
C
      DO 1700       I=1,30
      DO 1700       II=1,9
      M(II,I)=2*(RM(II)+(I-1)*10)
 1700 CONTINUE
C
      DO 1000 INDEXA=1,10000
C     ITIMED=(INDEXA-1)*IDTIME
      ITIMED=INDEXA*IDTIME
      IF(MOD(ITIMED,600).EQ.0)WRITE(5,*)'TIME IS ',ITIMED .
      ITOTDI=ITIMED
      IDEPTH=ITIMED
      IF(IDEPTH.GT.IBDEPT)IDEPTH=IBDEPT
      IF(IDEPTH.GT.IDDEPT)IDDEPT=IDEPTH
C
      IPAMB=(IDEPTH+33)*2.**5
      IPAO2=(.7*33.)*2.**5
      IPAO2=739
      IF(IDEPTH.LT.3)IPAO2=.21*IPAMB
      IPAN2=IPAMB-IPAO2-1.5*2.**5
      IPEXP=IPAMB-4.3*2.**5
      IPLIN=2.8*2.**5-IPAO2
```

```
C
          DO 100 I=1,9
          IF(IP(I).GT.(2.**(NEXP-5))*IPEXP)GOTO 50
          IA=(IP(I)-IPAN2*2.**(NEXP-5))/2.**(NEXP-5)
          IP(I)=IP(I)-1.*IA*IEXPTB(I)/2.**(IEXP-(NEXP-5))
          GOTO 100
C
 50       CONTINUE
          DPDT=1.*IPLIN*IEXPTB(I)/2.**4
          IDPDT=DPDT
          IP(I)=IP(I)+IDPDT*IDTIME
 100      CONTINUE
C
          ISADL=ISAD
          DO 20 J=30,1,-1
          DO 20 I=1,9
          JJ=J
          IF(M(I,J).LT.IP(I)/(2.**(NEXP-1)))GOTO 21
 20       CONTINUE
          JJ=0
 21       CONTINUE
          ISAD=JJ*10
          IAIND=2
          IF(IDEPTH.LT.(ISAD-2))IAIND=3
          IF(IDEPTH.GT.(ISAD+2))IAIND=1
          IF(ISAD.EQ.0)IAIND=1
C
          IF(ISAD.NE.ISADL)WRITE(5,*)'SAD=',ISAD,'  TIME=',ITIMED
C
          CALL WRIT(ITIMED,ITINT,LUNOUT,IDEPTH,
          1     ISAD,M,IP,ITHT,IBDEPT,NEXP,IEXP,IDTIME,IEXPTB)
 1000     CONTINUE
          END



          SUBROUTINE WRIT(ITIMED,ITINT,LUNOUT,IDEPTH,
          1     ISAD,IM,IP,ITHT,IBDEPT,NEXP,IEXP,IDTIME,IEXPTB)
C
          INTEGER*4 IP(9)
          DIMENSION IM(9,30),ITHT(9)
          DATA ISWTCH/0/
C
C-----------------------------------------------------------------------
C
C         PT=(ITIMED-IBDEPT)/60.
          PT=ITIMED/60.
          IPT=PT/10
C
          IF(ISWTCH.NE.0)GOTO 950
          IF(ISAD.LT.10)GOTO 950
          ISWTCH=1
          GOTO 960
 950      CONTINUE
C
          IF(ISAD.LT.10)GOTO 1000
          IF(PT.NE.IPT*10.)GOTO 1000
```

```
960       CONTINUE
          WRITE(5,*)'Time in seconds:                    ',ITIMED
          IF(LUNOUT.EQ.1)OPEN(UNIT=1,NAME='DIVING.DAT',
          1     TYPE='UNKNOWN',ACCESS='APPEND')
          WRITE(LUNOUT,*)'Time in seconds:                ',ITIMED
          WRITE(LUNOUT,*)'Time at bottom in minutes:      ',PT
          WRITE(LUNOUT,*)'Depth:                          ',IDEPTH
          WRITE(LUNOUT,*)(IP(I)/(2.**NEXP),I=1,9)
          WRITE(LUNOUT,*)' '
C
C Calculate minimum time to surface.
C
          CALL RISE(ITINT,LUNOUT,IDEPTH,ISAD,IM,
          1     IP,ITHT,NEXP,IEXP,IDTIME,IEXPTB)
C
          IF(LUNOUT.EQ.1)CLOSE(UNIT=1)
C
C-----------------------------------------------------------------------
C
 1000     CONTINUE
C
          RETURN
          END


          SUBROUTINE RISE(ITINT,LUNOUT,IDEPTH,ISAD,M,
          1     IP,ITHT,NEXP,IEXP,IDTIME,IEXPTB)
C
          INTEGER*4 IP(9),JP(9),IDPDT
          DIMENSION IEXPTB(9),M(9,30),ITHT(9),ISTIMS(20)
C
          SHIFT=2.**NEXP
          JDEPTH=IDEPTH
          ITINT=0
          IF(ISAD.EQ.0)GOTO 1500
C
          DO 15 I=1,9
          JP(I)=IP(I)
 15       CONTINUE
C
          DO 16 I=1,20
          ISTIMS(I)=0.
 16       CONTINUE
C
          JSAD=ISAD
 1000     CONTINUE
          JJ=JSAD*.1
          ITINT=ITINT+IDTIME
          IF(JSAD.LT.JDEPTH)JDEPTH=JDEPTH-IDTIME
          IF(JSAD.GE.JDEPTH)JDEPTH=JSAD
          IF(JJ.EQ.0)GOTO 19
          IF(JSAD.EQ.JDEPTH)ISTIMS(JJ)=ISTIMS(JJ)+IDTIME
 19       CONTINUE
C
          IPAMB=(JDEPTH+33)*2.**5
          IPAO2=(.7*33.)*2.**5
```

```
      IF(JDEPTH.LT.3)IPAO2=.21*IPAMB
      IPAN2=IPAMB-IPAO2-1.5*2.**5
      IPEXP=IPAMB-4.3*2.**5
      IPLIN=2.8*2.**5-IPAO2
C
      DO 100 I=1,9
      IF(JP(I).GT.(2.**(NEXP-5))*IPEXP)GOTO 50
      IA=(JP(I)-IPAN2*2.**(NEXP-5))/2.**(NEXP-5)
      JP(I)=JP(I)-1.*IA*IEXPTB(I)/2.**(IEXP-(NEXP-5))
      JP(I)=JP(I)/2**8
      JP(I)=JP(I)*2**8
      GOTO 100
C
 50   CONTINUE
      DPDT=1.*IPLIN*IEXPTB(I)/2.**4
      IDPDT=DPDT
      JP(I)=JP(I)+IDPDT*IDTIME
 100  CONTINUE
C
      DO 20 J=30,1,-1
      DO 20 I=1,9
      JJ=J
      IF(M(I,J).LT.JP(I)/(2.**(NEXP-1)))GOTO 21
 20   CONTINUE
      JJ=0
 21   CONTINUE
      JSAD=JJ*10
      IF(JDEPTH.GT.0)GOTO 1000
      WRITE(LUNOUT,*)' '
C
      DO 900 INDEXA=1,5
      WRITE(LUNOUT,9901)INDEXA*10,ISTIMS(INDEXA)/60.
 9901 FORMAT(' ','Stop time at ',I3,' feet: ',F7.2)
 900  CONTINUE
C
      GOTO 2000
 1500 CONTINUE
      ITINT=IDEPTH
C
 2000 CONTINUE
      WRITE(LUNOUT,*)'Minimum time to surface:  ',ITINT
      IMIN=ITINT/60
      ISEC=ITINT-IMIN*60
      WRITE(LUNOUT,*)'Minimum time to surface:  ',IMIN,':',ISEC
      WRITE(LUNOUT,*)' '
      WRITE(LUNOUT,*)'-----------------------------------'
      WRITE(LUNOUT,*)' '
C
      RETURN
      END
```

While the forms of the invention herein disclosed constitute presently preferred embodiments, many others are possible. It is not intended herein to mention all of the possible equivalent forms or ramifications of the invention. It is to be understood that the terms used herein are merely descriptive rather than limiting, and that various changes may be made without departing from the spirit or scope of the invention.

While the forms of the invention herein disclosed constitute presently preferred embodiments, many others are possible. It is not intended herein to mention all of the possible equivalent forms or ramifications of the invention. It is to be understood that the terms used herein are merely descriptive rather than limiting, and that various changes may be made without departing from the spirit or scope of the invention.

We claim:

1. Apparatus for carrying by a diver while under water (and at the surface between dives) and for providing information useful for enabling the diver to ascend therefrom both expeditiously and safely in order to avoid decompression sickness, comprising transducer means for providing an electrical capacitance responsive to the pressure of the water thereon, electronic circuit means comprising a resistance means in circuit with the transducer capacitance means for providing a signal responsive to the time constant therein and substantially unaffected by normally encountered variations in supply voltage, electronic data processing means, responsive to the signal from the resistance-capacitance circuit means, for computing the water pressure, the depth of the transducer capacitance means in the water, the minimum depth to which the diver can from there ascend safely, and the minimum time within which the diver then can ascend safely to the surface of the water, and means for providing indications perceptible to the diver of the computed values, the size, shape, and composition of the transducer capacitance means and the characteristics of the circuit, data processing, and indication providing means being such as to draw substantially less than ten milliamperes in total current, and thus to assure long usable life of the source of the current for the apparatus and essentially negligible magnetic influence on the surroundings.

2. Apparatus as in claim 1, wherein the transducer capacitance means comprises essentially a ceramic capacitance that is highly resistant to corrosion.

3. Apparatus as in claim 1, wherein the resistance-capacitance circuit means comprises means for providing a signal that varies in duration as a function of the pressure on the transducer capacitance means, and the data processing means comprises means for providing a digital signal that is responsive to the said duration and thus avoids any need for conventional analog-to-digital conversion circuitry.

4. Apparatus as in claim 1, wherein the resistance-capacitance circuit means includes temperature compensating means.

5. Apparatus as in claim 4, wherein the temperature compensating means comprises means for varying the resistance in the circuit means responsive to the temperature of the water around the transducer capacitance means.

6. Apparatus as in claim 5, wherein the resistance means comprises a thermistor.

7. Apparatus as in claim 1, wherein the data processing means comprises means for providing the computed values accurately in any of a plurality of ambient conditions that the apparatus typically is to be used in.

8. Apparatus as in claim 1, wherein the resistance-capacitance circuit means comprises means for providing a signal that varies in duration proportionally to the capacitance of the transducer means.

9. Apparatus as in claim 8, wherein the signal providing means comprises means for providing an oscillating voltage whose period is proportional to the time constant of the resistance-capacitance circuit means.

10. Apparatus as in claim 9, wherein the oscillating-voltage-providing means comprises amplifier means, means for providing a first potential as a first input to the amplifier means, and means for providing a second potential as a second input to the amplifier means.

11. Apparatus as in claim 10, wherein the said resistance means is connected in circuit with the first input to the amplifier means.

12. Apparatus as in claim 11, wherein the amplifier means comprises an operational amplifier means.

13. Apparatus as in claim 12, wherein the said resistance means is connected between the first potential and a first input terminal of the operational amplifier means.

14. Apparatus as in claim 13, wherein the second potential is connected to a second input terminal of the operational amplifier means.

15. Apparatus as in claim 1, including additional electronic circuit means comprising a resistance means, responsive to the temperature of the water around the pressure transducer means, in circuit with a capacitance means, for providing a signal responsive to the time constant therein and substantially unaffected by normally encountered variations in the supply voltage; and wherein the data processing means includes means responsive to the signal from the additional circuit means for correcting the computed value of the water pressure to compensate for variation in the response of the pressure transducer means with variation in the temperature of the ambient water.

16. Apparatus for carrying by a diver while under water (and at the surface between dives) and for providing information useful for enabling the diver to ascend therefrom both expeditiously and safely in order to avoid decompression sickness, comprising transducer means for providing an electrical capacitance responsive to the pressure of the water thereon, electronic circuit means comprising a resistance means in circuit with the transducer capacitance means for providing a signal responsive to the time constant therein and substantially unaffected by normally encountered variations in supply voltage, such that the signal varies in duration proportionally to the capacitance of the transducer means and comprises an oscillating voltage whose period is proportional to the said time constant, the said circuit means comprising operational amplifier means, means for providing a first potential as a first input to the amplifier means, and means for providing a second potential as a second input to the amplifier means, the said resistance means being connected between the first potential and a first input terminal of the amplifier means, and the second potential being connected to a second input terminal of the amplifier means, a voltage comparator means, means for connecting the output of the amplifier means to a first input terminal of the voltage comparator means, and means for connecting a third potential to a second input terminal of the voltage comparator means;

electronic data processing means, responsive to the signal from the resistance-capacitance circuit means, for computing the water pressure, the depth of the transducer capacitance means in the water, the minimum depth to which the diver can from there ascend safely, and the minimum time within which the diver then can ascend safely to the surface of the water, and means for providing indications perceptible to the diver of the computed values.

17. Apparatus as in claim 16, comprising also means responsive to the voltage comparator means for periodically interchanging the connections of the first and third potentials.

18. Apparatus as in claim 17, wherein the potential providing means comprise voltage source means connected to voltage divider means; means for connecting a first input terminal of the operational amplifier means in circuit with a first point, at a first potential, on the voltage divider means; means for connecting a second input terminal of the operational amplifier means in circuit with a second point, at a different potential, on the voltage divider means; and means for connecting a second input terminal of the voltage comparator means in circuit with a third point, at a still different potential, on the voltage divider means.

19. Apparatus as in claim 18, wherein the potential at the second point on the voltage divider means is midway between the potential at the first point and the potential at the third point.

20. Apparatus as in claim 19, wherein the periodically interchanging means comprises means for first connecting the resistance means to the first point on the voltage divider means while connecting the second input terminal of the voltage comparator means to the third point, then connecting the resistance means to the third point on the voltage divider means while connecting the second input terminal on the voltage comparator means to the first point, then back to the first-mentioned connections, and so on alternately between the first-mentioned connections and the second-mentioned connections.

21. Apparatus for carrying by a diver while under water (and at the surface between dives) and for providing information useful for enabling the diver to ascend therefrom both expeditiously and safely in order to avoid decompression sickness, comprising transducer means for providing an electrical capacitance responsive to the pressure of the water thereon, electronic circuit means comprising a resistance means in circuit with the transducer capacitance means for providing a signal responsive to the time constant therein and substantially unaffected by normally encountered variations in supply voltage, electronic data processing means, responsive to the signal from the resistance-capacitance circuit means, for computing the water pressure, the depth of the transducer capacitance means in the water, the minimum depth to which the diver can from there ascend safely, and the minimum time within which the diver then can ascend safely to the surface of the water, and means for providing indications perceptible to the diver of the computed values, the said data processing means comprising means for carrying out the operations listed in the Data Processing Software Summary in the foregoing specification.

22. Apparatus for providing an electrical signal that varies in duration proportionally to the product of a resistance therein multiplied by a capacitance therein, comprising operational amplifier means;

capacitance means connected between the output terminal and a first-input terminal of the operational amplifier means;

resistance means connected, at one end, to the first input terminal of the operational amplifier means and, at the opposite end, to means for providing a first potential;

means for providing a second potential to a second input terminal of the operational amplifier means;

means for connecting the output of the operational amplifier means to a first input terminal of voltage comparator means;

means for providing a third potential to a second input terminal of the voltage comparator means; and means for periodically interchanging the value of the first potential with the value of the third potential.

23. Apparatus as in claim 22 wherein the second potential is midway between the first and third potentials.

24. Apparatus as in claim 23, wherein the potential providing means comprise voltage source means connected to voltage divider means; means for connecting the first input terminal of the operational amplifier means in circuit with a first point, at a first potential, on the voltage divider means; means for connecting the second input terminal of the operational amplifier means in circuit with a second point, at a different potential, on the voltage divider means; and means for connecting the second input terminal of the voltage comparator means in circuit with a third point, at a still different potential, on the voltage divider means.

25. Apparatus as in claim 24, wherein the periodically interchanging means comprises means for first connecting the resistance means to the first point on the voltage divider means while connecting the second input terminal of the voltage comparator means to the third point, then connecting the resistance means to the third point on the voltage divider means while connecting the second input terminal of the voltage comparator means to the first point, then back to the first-mentioned connections, and so on alternately between the first-mentioned connections and the second-mentioned connections.

* * * * *